US007484311B2

(12) United States Patent
Bommarito

(10) Patent No.: US 7,484,311 B2
(45) Date of Patent: Feb. 3, 2009

(54) PICTURE HANGING MEASURING DEVICE

(76) Inventor: Gina Bommarito, 145 E. 13 Mile Rd., Royal Oak, MI (US) 48073

( * ) Notice: Subject to any disclaimer, the term of this patent is extended or adjusted under 35 U.S.C. 154(b) by 36 days.

(21) Appl. No.: 11/675,604

(22) Filed: Feb. 15, 2007

(65) Prior Publication Data

US 2008/0196262 A1 Aug. 21, 2008

(51) Int. Cl.
*G01B 5/24* (2006.01)
*B25H 7/00* (2006.01)

(52) U.S. Cl. ..... 33/613

(58) Field of Classification Search ..... 33/613, 33/645

See application file for complete search history.

(56) References Cited

U.S. PATENT DOCUMENTS 4,241,510 A * 12/1980 Radecki ..... 33/613
4,485,561 A * 12/1984 Hopkins, Sr. ..... 33/574
4,517,860 A * 5/1985 Dameron, Jr. ..... 33/613
6,032,378 A * 3/2000 Null ..... 33/613
6,049,991 A * 4/2000 Gruenberg et al. ..... 33/613
6,185,831 B1 * 2/2001 Pluciennik ..... 33/613
6,739,065 B2 * 5/2004 Hofmeister et al. ..... 33/613
6,971,184 B2 * 12/2005 Prevost ..... 33/613
7,181,861 B1 * 2/2007 Leser ..... 33/494
7,226,032 B2 * 6/2007 Schlais et al. ..... 33/645
2003/0051363 A1 * 3/2003 Hofmeister et al. ..... 33/613
2004/0177527 A1 * 9/2004 Prevost ..... 33/613

* cited by examiner

*Primary Examiner*—G. Bradley Bennett
(74) *Attorney, Agent, or Firm*—Rader, Fishman & Grauer, PLLC

(57) ABSTRACT

A measuring device is provided that includes a vertical member, at least one hanging element and an adjustable ledge. The hanging element is fixedly attached to the vertical member and extends outwardly from a surface thereof. The adjustable ledge is selectively slideable in a vertical direction along at least a portion of the vertical member. The hanging element and the adjustable ledge cooperate to define a vertical distance therebetween.

22 Claims, 8 Drawing Sheets

PICTURE HANGING MEASURING DEVICE

TECHNICAL FIELD

The present disclosure relates to a measuring device, and more particularly to a measuring device for hanging picture frames.

BACKGROUND

Typically, a hanger nail, screw or other similar expedient is mounted to a wall and then engaged with a hanging mechanism of a picture frame, such as a wire. The precise positioning of the hanger nail is always problematic since it is difficult to precisely locate the exact point on the wall where the nail should be affixed to achieve the desired location of the picture frame. This problem is compounded with an oversized picture frame that requires two or more suspension points to hang the picture on the wall.

Picture hanging devices are known. Typical picture hanging devices include at least a hook or boss for accommodating the hanging mechanism of a picture frame. In some known hanging devices, at least one marking element extends from the hook accommodating the hanging mechanism of a picture frame, towards the surface where the picture is to be hung. The marking element leaves an indentation on the wall when it is pressed downwardly, indicating where a hanger nail should be affixed.

One known picture hanging device having a sliding member for accommodating the hanging mechanism of a picture frame includes a threaded stud for selectively retaining the sliding member. The sliding member is mounted in a slot that extends along a portion of the vertical leg. A horizontal leg extends from the top edge of the vertical leg to form a T-shape. A lip extends outwardly in the forward direction from the top edge of the horizontal leg. The sliding member is locked in place by the threaded stud to indicate the vertical position of a point relative to the top edge. The picture hanging device is positioned adjacent the rear surface of a picture frame such that the lip of the horizontal leg rests on the top edge of the frame. The hanging mechanism of the frame, such as a wire, is pulled taut to the position where it will be when the frame is hung. The sliding member is then moved to the apex of the wire and is locked into position. The picture hanging device is then removed from the frame, and is placed upon the wall where the picture frame is to be hung. The position of the sliding member indicates the hanger nail's position, and the lip located on the horizontal member indicates the position of the top edge of the picture frame.

While the picture hanging devices described above indicate where the nail should be applied, these picture hanging devices have disadvantages. For example, it is usually time-consuming and cumbersome to engage and disengage the threaded stud, which must be secured to adequately retain the picture frame and accurately determine a location for the hanger nail or screw.

BRIEF SUMMARY

A measuring device is disclosed that includes a vertical member, at least one hanging element, and a vertical ledge. The hanging element is fixedly attached to the vertical member and extends outwardly from a surface thereof. The adjustable ledge is selectively slideable in a vertical direction along at least a portion of the vertical member. The hanging element and the adjustable ledge cooperate to define a vertical distance therebetween.

BRIEF DESCRIPTION OF THE DRAWINGS

Other features and advantages of the measuring device will become apparent to those skilled in the art from the following detailed description of embodiments thereof, when read in light of the accompanying drawings, in which.

DETAILED DESCRIPTION

Illustrative embodiments are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints that will vary from one implementation to another. Moreover, it will be appreciated that such a development effort might be complex and time-consuming, but would nevertheless be a routine undertaking for those of ordinary skill in the art having the benefit of this disclosure.

Figure 1:
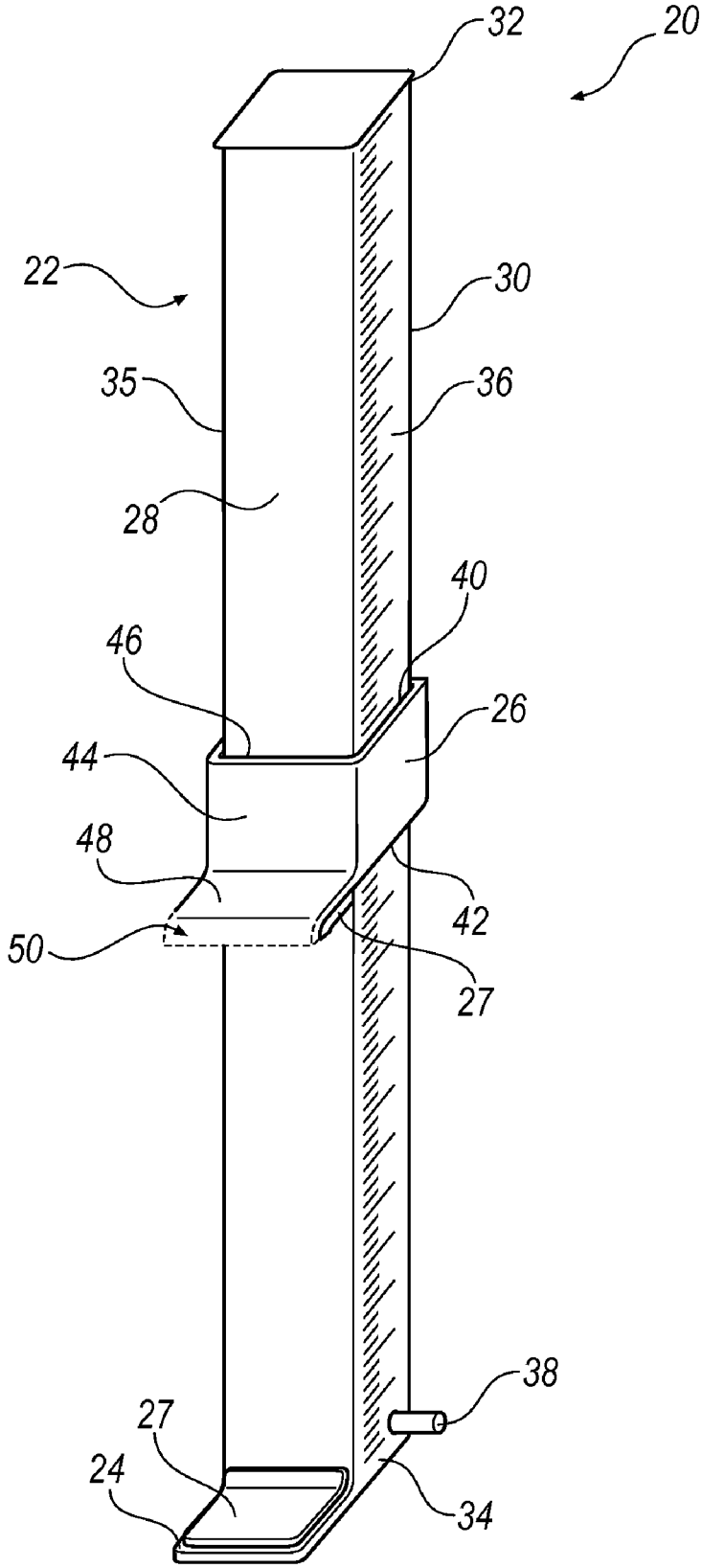
FIG. 1 is an elevational perspective view of one embodiment of a measurement device.
Figure 2:
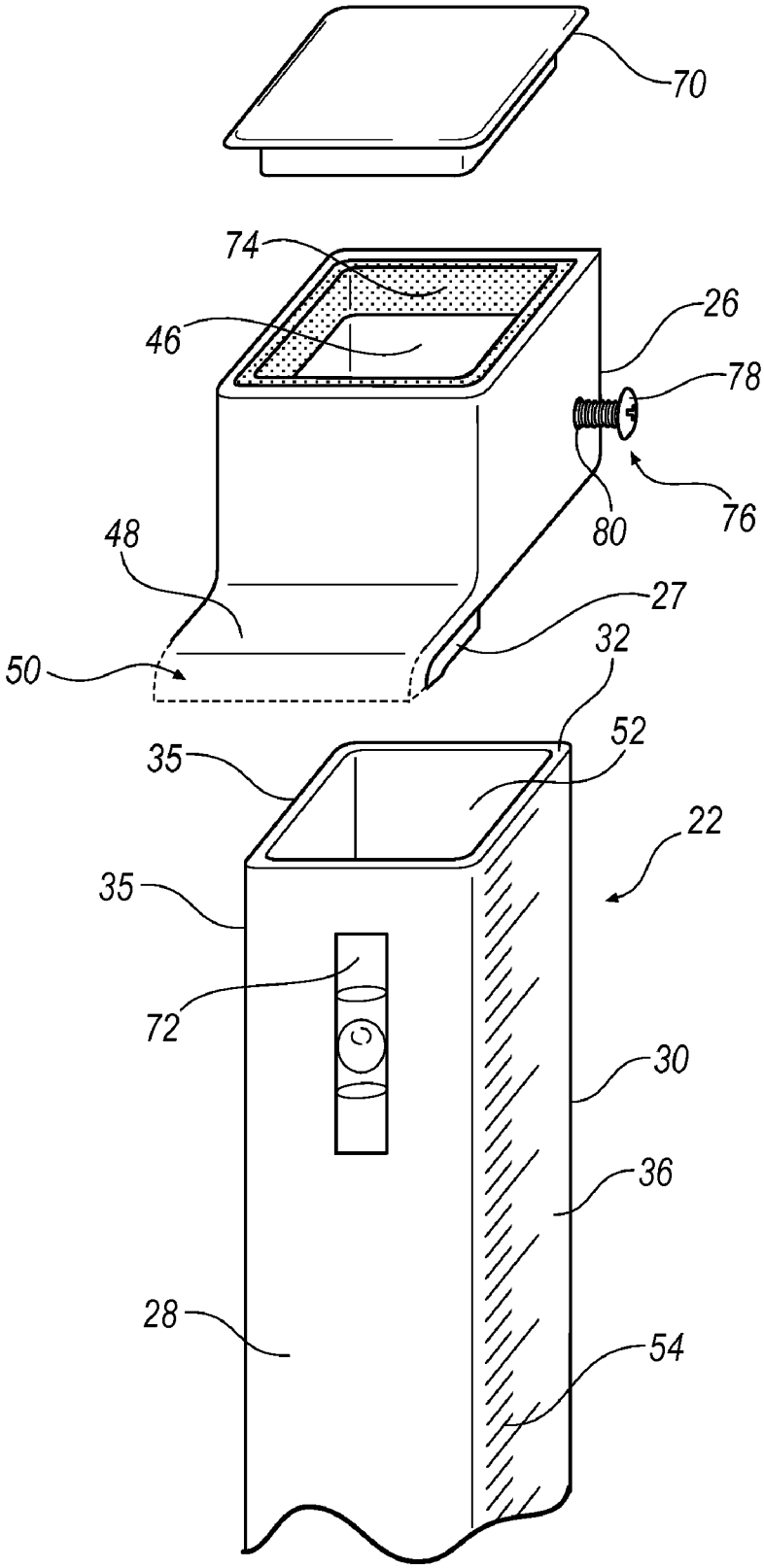
FIG. 2 is an enlarged, partially exploded perspective view of the measurement device, including a cap, an adjustable ledge and a vertical member.
Figure 3:
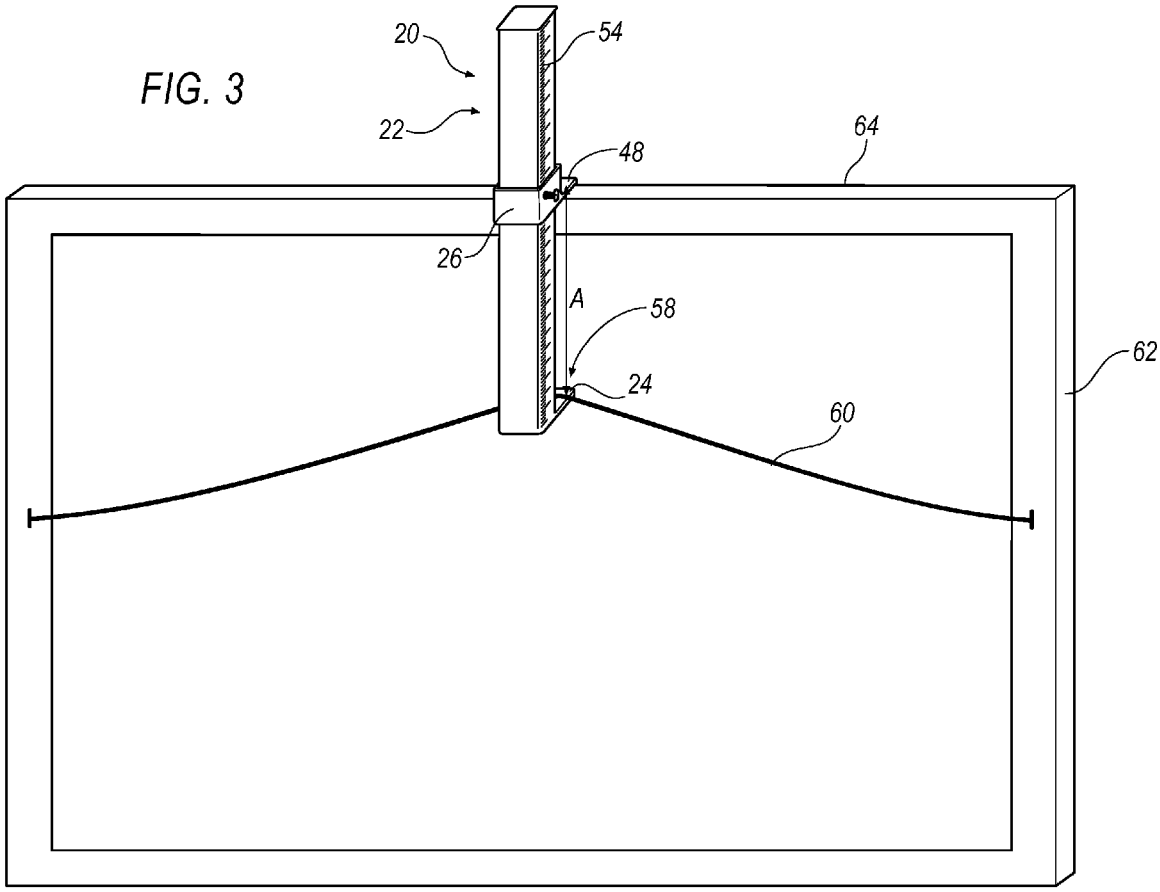
FIG. 3 is an elevational perspective view of the measurement device disposed along the back side of a picture frame therein.

Turning now to the drawings, and in particular to FIGS. 1-3, a first embodiment of a measuring device 20 is disclosed. Although measuring device 20 is described to hang a picture frame on a wall, it is understood measuring device 20 may be utilized for a variety of different purposes. Measuring device 20 includes a vertical member 22, at least one hanging element 24 and an adjustable ledge 26. Vertical member 22 includes a front surface 28, a rear surface 30, top edge 32, a bottom edge 34 and opposing side surfaces 35 and 36.

Hanging element 24 may be fixedly attached to vertical member 22 and extends outwardly away from any one of front surface 28, rear surface 30 or opposing side surfaces 35 and 36. The embodiment of FIG. 1 illustrates hanging element 24 disposed on bottom edge 34 and extending outwardly away from front surface 28. Any type of hanging mechanism of a picture frame, such as a wire or a serrated surface may be suspended from hanging element 24. Hanging element 24 may include any element that is suitable for engagement with the wire of the picture frame, such as, but not limited to, a ledge, a lip, a hook and a boss.

Adjustable ledge 26 is coupled to and is selectively slideable in the vertical direction along at least a portion of vertical member 22. At least one of front surface 28, rear surface 30, and opposing side surfaces 35 and 36 of vertical member 22 may be encircled by adjustable ledge 26. In the embodiment shown, adjustable ledge completely encircles vertical member 22. Additionally, adjustable ledge 26 may slide along vertical member 22 when a force is selectively manually applied to adjustable ledge 26. Adjustable ledge 26 further includes a top edge 40, a bottom edge 42, an outer surface 44, an inner surface 46 and a protrusion 48 extending outwardly therefrom. Protrusion 48 generally opposes hanging element 24 in the vertical direction.

Vertical member 22 may further include an additional stopper 38 disposed proximate bottom edge 34. Stopper 38 retains adjustable ledge 26 at a desired location along vertical member 22, such that adjustable ledge 26 will contact stopper 38 first, instead of hanging element 24 when the selective manual force is applied downwardly. Thus, stopper 38 may prevent hanging element 24 from undesired, and potentially damaging contact with adjustable ledge 26 when adjustable ledge 26 slides downwardly along vertical member 22.

In addition, a protective layer 27 may line at least one of adjustable ledge 26 and hanging element 24. Adjustable ledge 26 may include protective layer 27 disposed on at least one of bottom edge 42 and protrusion 48, as well as a top surface of hanging element 24. Protective layer 27 may be any type of shock-absorbing material that will protect and minimize wear if adjustable ledge 26 contacts hanging element 24. Protective layer 27 also serves to protect an item to which measuring device 20 is applied, as well be explained below. It should be noted that protective layer 27 may also be substituted in place of stopper 38. Protective layer 27 may be constructed from materials such as, but not limited to, a foam, a polymer or a flock tape.

In one embodiment, protrusion 48 may include a downwardly extending lip 50, shown in phantom. Downwardly extending lip 50 may be used to assist in engaging an edge of a picture frame, such as a picture frame 62 as seen in FIG. 3, with measuring device 20 such that frame 62 is generally parallel with vertical member 22.

FIG. 2 illustrates a detailed, partially exploded view a portion of vertical member 22, adjustable ledge 26, and a cap 70. Measuring device 20 is assembled together by first sliding adjustable ledge 26 onto vertical member 22, past top edge 32. In one embodiment, cap 70 may be affixed to top edge 32 after adjustable ledge 26 is slid onto vertical member 22. Since cap 70 has a larger area than the perimeter of inner surface 46 of adjustable ledge 26, cap 70 retains adjustable ledge 26 along vertical member 22.

In the embodiment shown in FIG. 2, vertical member 22 is hollow and includes a void 52 disposed within vertical member 22. Vertical member 22 may be hollow so as to minimize the weight of measuring device 20, and to save on material cost. Additionally, vertical member 22 may also include a vertical leveling bubble 72 to indicate if measuring device 20 is in a vertically upright position.

Inner surface 46 of adjustable ledge 26 opposes front surface 28, rear surface 30, and opposing side surfaces 35 and 36 of vertical member 22. In one embodiment, an expandable, low-function material 74, such as, but not limited to, a felt, a flock tape or a foam may at least partially line inner surface 46. Material 74 has rigidity such that material 74 may be used to retain adjustable ledge 26 in place along vertical member 22 when desired, but still flexible enough to allow adjustable ledge 26 to slide along vertical member 22 as well.

Adjustable ledge 26 may also include a stopper element 76. Stopper element 76 may be disposed on outer surface 44 of adjustable ledge 26, and includes at least one retaining element 78. When adjustable ledge 26 is at a desired location along vertical member 22, stopper element 76 may selectively retain adjustable ledge 26 along vertical member 22 by way of retaining element 78. In the embodiment shown in FIG. 2, retaining element 78 is a screw, and is threadingly engaged with an aperture 80. However, it is understood that stopper element 76 may include any type of retaining element 78 that selectively retains adjustable ledge 26 along vertical member 22, such as, but not limited to, a push-pin or an adjustable rod.

Use of measuring device 20 will now be described. As best seen by FIG. 3, hanging element 24 is engaged with a wire 60 that is attached to either side of frame 62 by lifting the measuring device 20 relative to frame 62 such that an apex 58 is formed in wire 60. Thus, wire 60 is pulled taut and is positioned on measuring device 20 so as to be in the position when frame 62 is suspended from a wall. Apex 58 represents the point where any suitable hanging mechanism, such as a nail or a screw, is affixed to a wall. Adjustable ledge 26 is then manually slid along vertical member 22 such that protrusion 48 generally engages with a top edge 64 of frame 62, and hanging element 24 and adjustable ledge 26 cooperate to define a vertical distance A therebetween.

The vertical distance A represents the distance between top edge 64 of frame 62 and apex 58 of wire 60. More specifically, vertical distance A represents a distance between a hanging mechanism for frame 62 when frame 62 is suspended from a wall, and a position along top edge 64 of frame 62. Vertical member 22 may further include graduated markings 54 to aid in measuring vertical distance A. Graduated markings 54 may be measured in inches, centimeters or any other appropriate measuring system.

Figure 4:
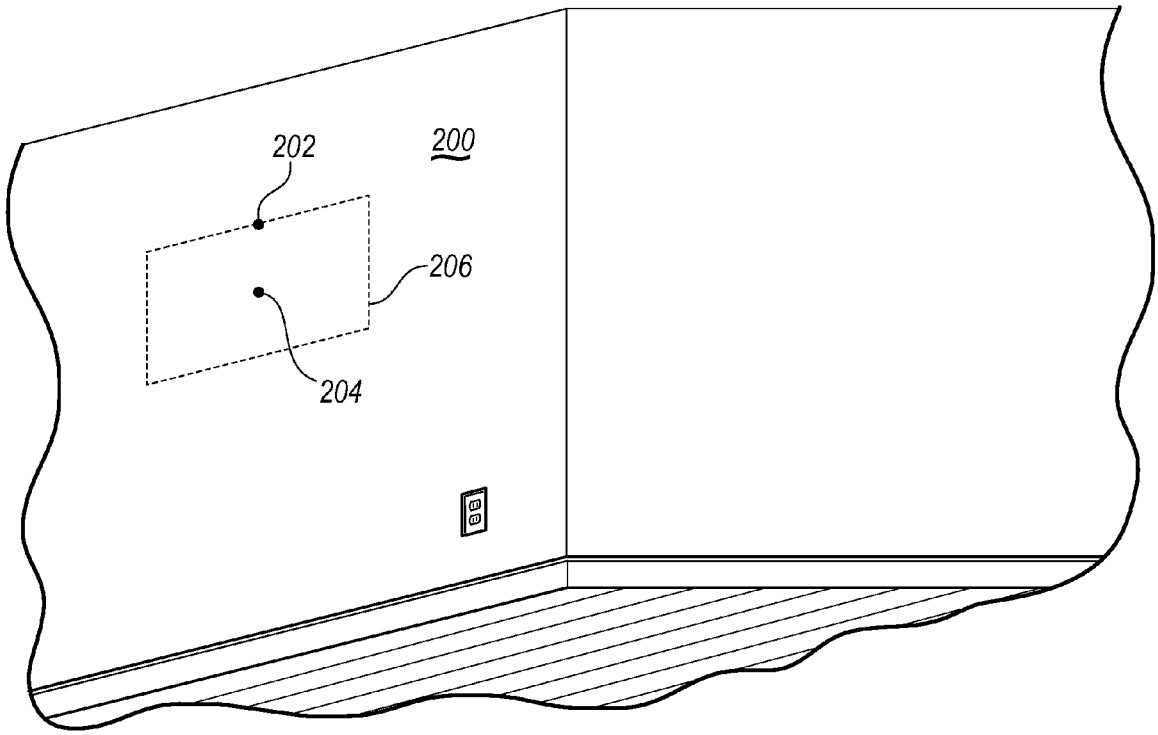
FIG. 4 is an elevational perspective view of a wall where the picture frame illustrated in FIG. 2 is suspended.

Although FIG. 4 illustrates a wall 200 where measuring device 20 is utilized to hang a picture frame, it is understood any embodiment of measuring device 20, such as a measuring device 120 that is discussed below, may hang frame 62 at a predetermined, desired location on wall 200. Frame 62 is placed on wall 200 in the desired location 206. Location 206 represents where frame 62 may be suspended from wall 200, and a mark is applied to a first position 202 on wall 200 where top edge 64 of frame 62 is desired. Then, as best seen by FIG. 3, measuring device 20 engages wire 60 of frame 62 with hanging element 24 of measuring device 20. Adjustable ledge 26 slides to engage protrusion 48 with top edge 64 of frame 62 when a selective manual force is applied. Frame 62 is then removed from measuring device 20. Adjustable ledge 26 is then aligned with first position 202 on wall 200. A second position 204 is then marked on wall 200 where hanging element 24 is located. Second position 204 indicates a location where a hanging device, such as a nail or a screw, should be affixed to wall 200.

Figure 5:
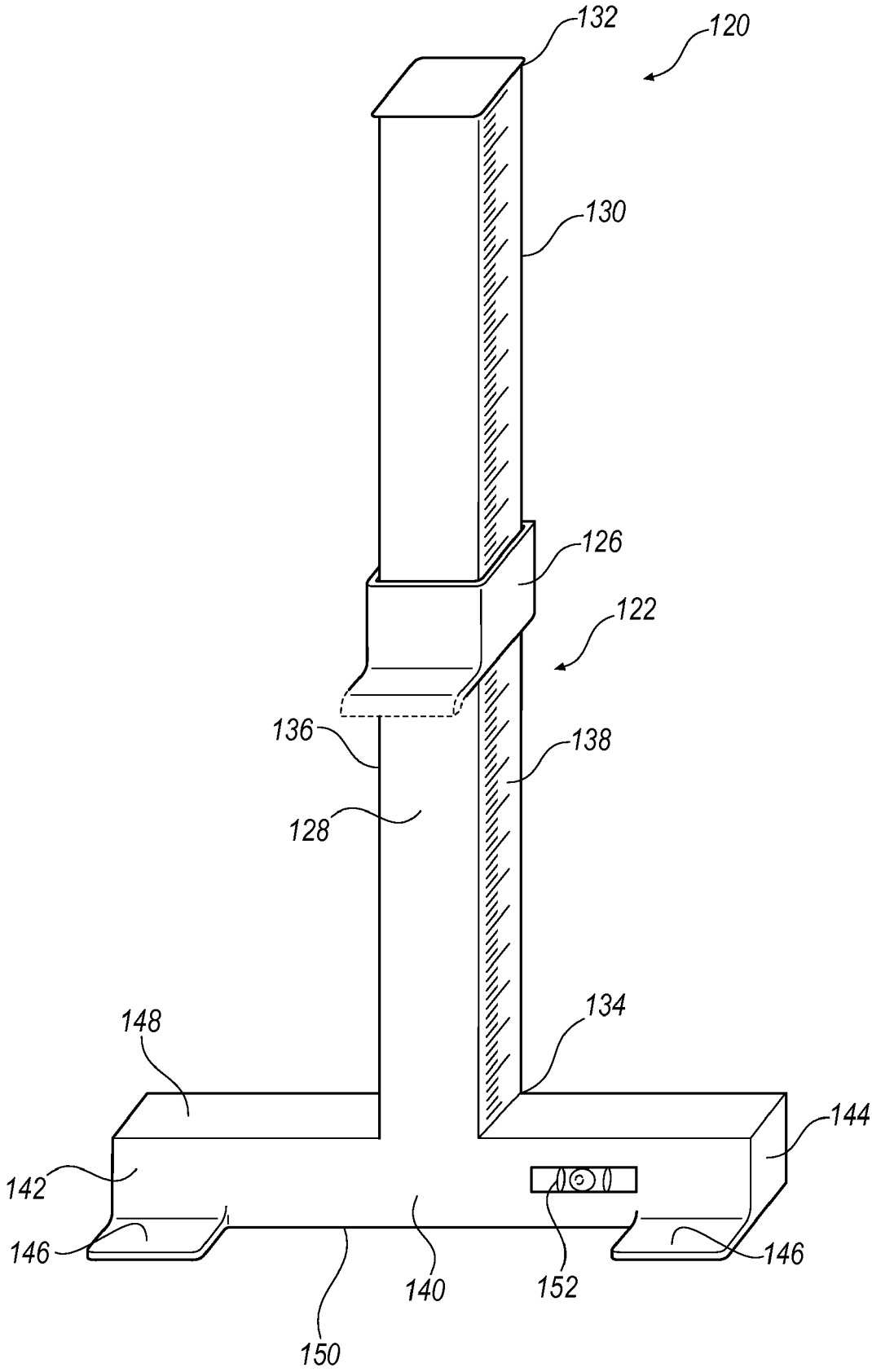
FIG. 5 is an elevational perspective view of a second embodiment of a measurement device.
Figure 6:
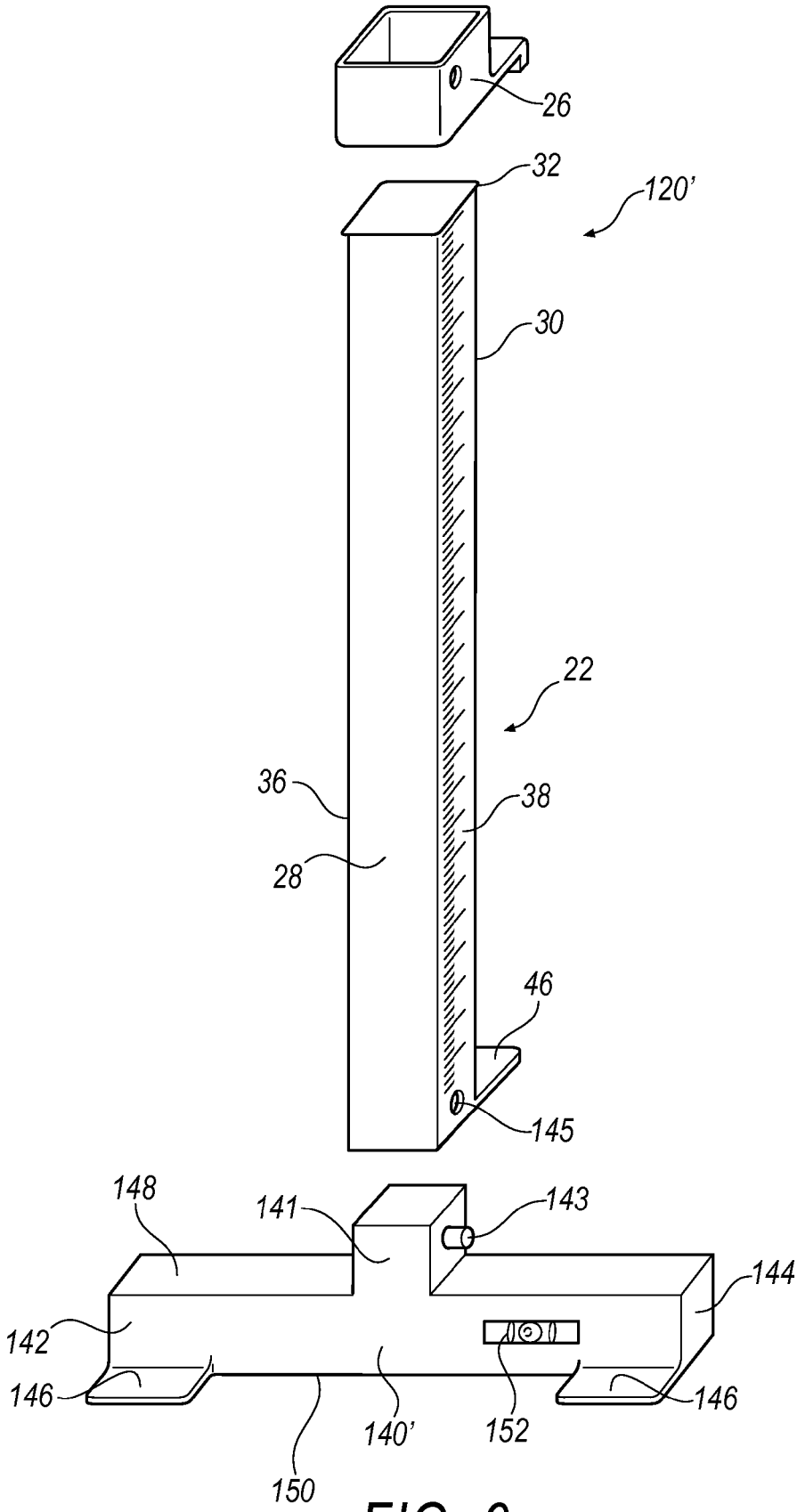
FIG. 6 is an alternative embodiment of the measurement device.

An alternative embodiment of a measuring device 120 is shown in FIGS. 5-6. Measuring device 120 may include hanging elements 146 that are suitable for large pictures that require two or more suspension points. Measuring device 120 includes a vertical member 122, a horizontal member 140 and an adjustable ledge 126. Vertical member 122 includes a front surface 128, a rear surface 130, a top edge 132, a bottom edge 134 and opposing side surfaces 136 and 138.

Horizontal member 140 includes a first end 142, a second end 144, with first end 142 being a predetermined horizontal distance spaced apart from second end 144. In the embodiment shown in FIG. 5, at least two hanging elements 146 are disposed on horizontal member 140 and extend outwardly away from front surface 128 of vertical member 122. One of hanging elements 146 is disposed at first end 142, and the other of hanging elements 146 is disposed at second end 144. Hanging elements 146 may also be disposed on a top side 148 or a bottom side 150 of horizontal member 140. In the embodiment shown in FIG. 4, hanging elements 146 are tabs. However, it is understood that hanging elements 146 may also be any element suitable to receive a hanging mechanism of a picture frame, such as, but not limited to, a ledge, a lip, a hook and a boss.

Figure 5A:
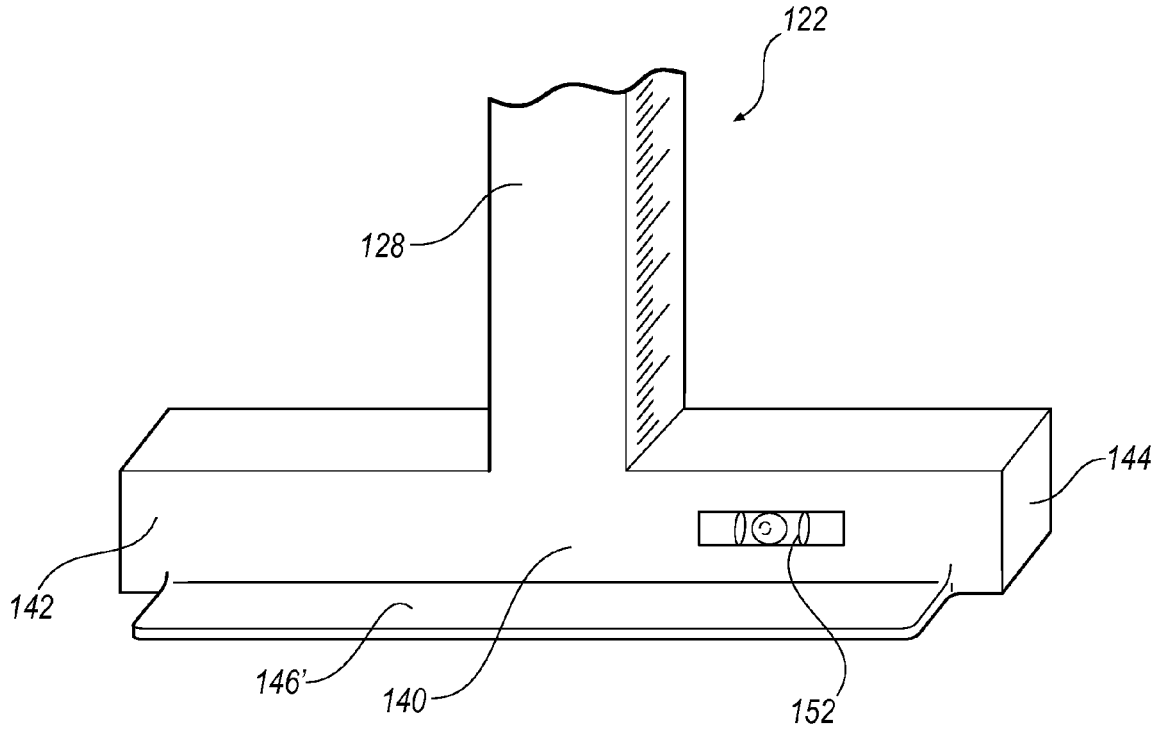
FIG. 5A is an enlarged, elevational perspective view of an alternative embodiment of the hanging element of the measurement device illustrated in FIG. 4.

In one embodiment, as seen in FIG. 5A, horizontal member 140 may include an alternative hanging element 146' that extends at least partially along horizontal member 140 and projects outwardly away from front surface 128 of vertical member 122. Horizontal member 140 may include a horizontal leveling bubble 152 to ensure that first end 142 is aligned with second end 144. Hanging element 146' may further include a lip, or may be curved to assist in retaining a wire.

FIG. 6 is an alternative embodiment of the measuring device 120. In this embodiment, measuring device 120' includes two separate pieces, a hollow vertical member 22 that is similar to that which is shown in FIG. 1, and a separate horizontal member 140'. Horizontal member 140' is similar to horizontal member 140 in that it includes one or more hanging elements 146 or 146'. In addition, horizontal member 140' further includes an upwardly extending mounting post 141. Mounting post 141 further includes a selectively depressible pin 143 that is biased into an extended position as indicated in FIG. 6.

To assemble measuring device 120', vertical member 22 is positioned over mounting post 141 and depressible pin 143 is depressed inwardly such that mounting post 141 may be received within a bottom portion of vertical member 22. Once mounting post 141 is received within vertical member 22, pin 143 returns to the extended position through an opening 145 formed in vertical member 22. Pin 143 serves to secure vertical member 22 to horizontal member 140'. In one embodiment, vertical member 22 is rotated 180° such that the hanging element 46 extends in an opposite direction of hanging elements 146/146'. Alternatively, hanging elements 146 may be provided so as to extend from a top surface of horizontal member 140', rather than a bottom surface as shown in FIG. 6, and vertical member 22 may be positioned such that hanging element 46 also generally aligns with hanging elements 146 to provide an additional support area. Thus, as the vertical member 22 is selectively removable from horizontal member 140', the embodiment shown in FIG. 6 is versatile in that it may be used for either small or large items.

Figure 7:
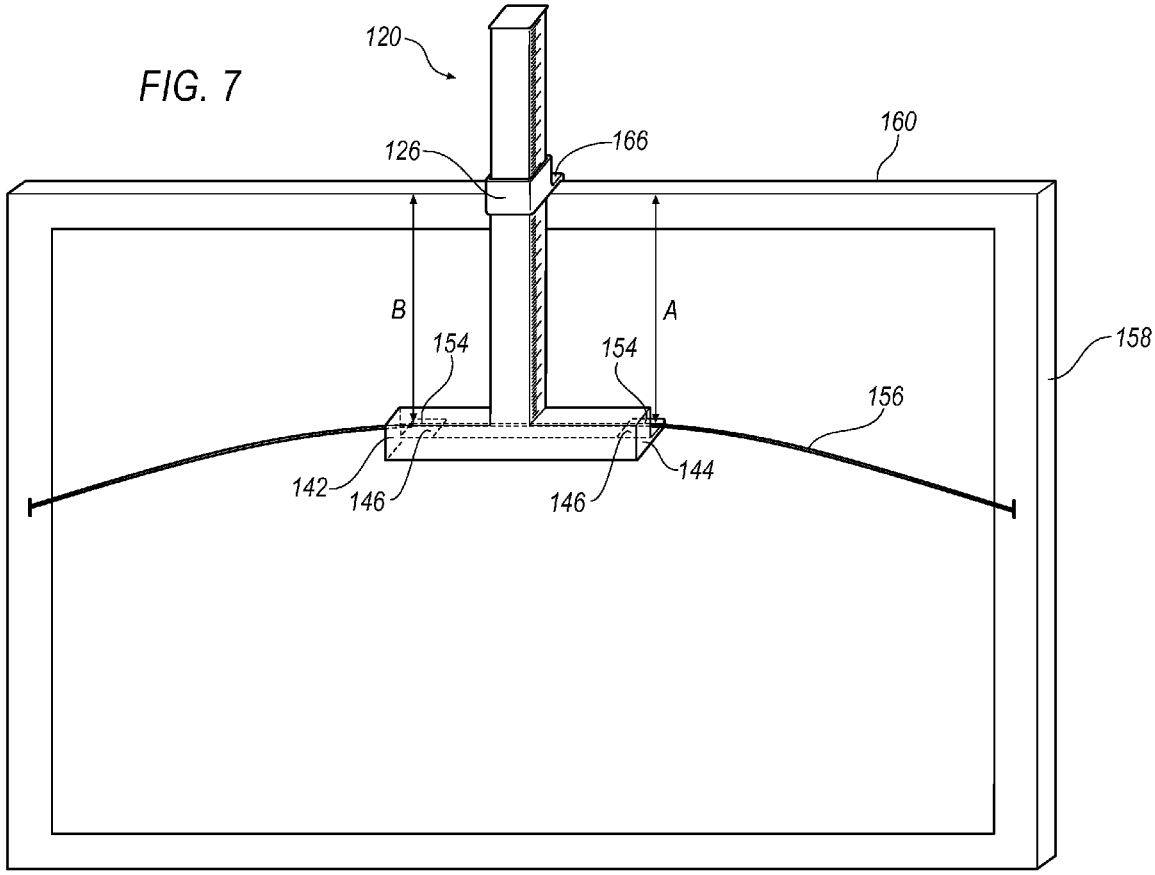
FIG. 7 is an elevational perspective view of the measurement device as illustrated in FIG. 4 disposed along a back side of a picture frame therein.

As seen in FIG. 7, hanging elements 146 are engaged with a wire 156 by lifting measuring device 120 relative to an oversized frame 158 such that two apexes 154 (one shown in phantom line) are formed. As discussed above, wire 156 is pulled taut and is positioned on measuring device 120 so as to be in the position when frame 158 is suspended from a wall, such as wall 200 as illustrated in FIG. 4. A protrusion 166 generally engages with a top edge 160 of frame 158, and both of hanging elements 146 and adjustable ledge 126 cooperate to define two vertical distances A and B therebetween. Vertical distances A and B represent the distance between top edge 160 of frame 158 and apexes 154 of wire 156.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A measuring device comprising:

a vertical member;

at least one hanging element fixedly attached to said vertical member and extending outwardly away from a surface thereof; and an adjustable ledge selectively slideable in a vertical direction along at least a portion of said vertical member, said adjustable ledge further including a protrusion extending outwardly and substantially horizontally therefrom;

wherein said hanging element and said adjustable ledge cooperate to define a vertical distance therebetween.

2. The measuring device of claim 1, wherein said hanging element is one of a ledge, a lip, a hook and a boss.

3. The measuring device of claim 1, wherein said adjustable ledge encircles at least a portion of said vertical member.

4. The measuring device of claim 1, wherein said adjustable ledge further includes an inner surface at least partially lined with a low-friction material.

5. The measuring device of claim 4, wherein said material is one of a felt, a foam and a flock tape.

6. The measuring device of claim 1, wherein said protrusion further includes a lip extending downwardly therefrom.

7. The measuring device of claim 1, wherein said adjustable ledge further includes a stopper element that selectively retains said adjustable ledge along said vertical member.

8. The measuring device of claim 1, wherein said vertical member further includes a vertical leveling bubble.

9. The measuring device of claim 1, wherein said measuring device further includes a horizontal member defined by spaced apart first and second ends.

10. The measuring device of claim 9, wherein the horizontal member includes an elongated hanging element extending substantially the length of the horizontal member.

11. The measuring device of claim 9, wherein the horizontal member includes at least two hanging elements.

12. The measuring device of claim 11, wherein one of said hanging elements is disposed at said first end, and the other of said hanging elements is disposed at said second end.

13. The measuring device of claim 9, wherein said horizontal member further includes a horizontal leveling bubble.

14. The measuring device of claim 9, wherein the vertical member is selectively detachable from the horizontal member.

15. The measuring device of claim 14, wherein the horizontal member includes a mounting post that may be selectively received within the vertical member and a retaining mechanism that secures the vertical member to the mounting post.

16. The measuring device of claim 15, wherein the retaining member is a selectively depressible pin that engages an opening formed in the vertical member.

17. The measuring device of claim 1, wherein said vertical member includes graduated markings to indicate said vertical distance.

18. The measuring device of claim 1, wherein said vertical member further includes a top edge and a cap, said cap affixed to said top edge and retaining said adjustable ledge along said vertical member.

19. The measuring device of claim 1, wherein said vertical member further includes a stopper disposed proximate said bottom edge, said stopper retaining said adjustable ledge at a desired location along said vertical member.

20. A measuring device for hanging a picture frame at a predetermined, desired location comprising:

a vertical member;

at least one hanging element fixedly attached to said vertical member and extending outwardly away from a surface thereof;

an adjustable ledge encircling at least a portion of said vertical member and disposed above said hanging element, wherein said adjustable ledge is selectively slideable in a vertical direction along at least a portion of said vertical member;

wherein said hanging element and said adjustable ledge cooperate to define a vertical distance therebetween;

wherein said vertical distance represents a distance between a hanging mechanism of the frame when said frame is suspended from a wall and a position along a top edge of said frame;and a protrusion extending outwardly and substantially horizontally from said adjustable ledge.

21. The measuring device of claim 20, wherein said measuring device further includes a horizontal member defined by spaced apart first and second ends.

22. A method for hanging a picture frame at a predetermined, desired location, comprising the steps of:

marking a first position on a wall where a top edge of the frame is desired;

engaging a hanging mechanism of said frame with a hanging element of a measuring device;

sliding an adjustable ledge of said measuring device in contact with said top edge of said frame such that said top edge of said frame is engaged with a protrusion extending outwardly and substantially horizontally from said adjustable ledge;

removing said frame from said measuring device;

aligning said adjustable ledge with said first position on said wall, and marking a second position on said wall where said hanging element is located;

wherein said hanging element indicates a location where a hanging device should be affixed to said wall.

* * * * *